United States Patent [19]

Achrekar

[11] 4,170,943

[45] Oct. 16, 1979

[54] ROLLER COASTER ASSEMBLY

[76] Inventor: Prakash M. Achrekar, 1013 Tamarak Ave., Brea, Calif. 92621

[21] Appl. No.: 820,766

[22] Filed: Aug. 1, 1977

[51] Int. Cl.[2] ..... A63G 21/08

[52] U.S. Cl. ..... 104/56; 104/75; 105/156

[58] Field of Search ..... 104/56, 57, 63, 74–76, 104/118, 167; 46/216, 260; 105/156

[56] References Cited

U.S. PATENT DOCUMENTS

| | | | |
|---|---|---|---|
| 1,127,753 | 2/1915 | Glynn | 104/63 |
| 3,319,581 | 5/1967 | Churchman et al. | 104/57 |
| 3,889,605 | 6/1975 | Bacon | 104/56 |
| 4,034,678 | 7/1977 | Wilson | 104/118 |

FOREIGN PATENT DOCUMENTS

| | | | |
|---|---|---|---|
| 1958218 | 6/1971 | Fed. Rep. of Germany | 46/216 |

*Primary Examiner*—Trygve M. Blix
*Assistant Examiner*—Ross Weaver
*Attorney, Agent, or Firm*—Lyon & Lyon

[57] ABSTRACT

An improved roller coaster system is provided having a track in the shape of a mobius band and a carriage assembly mounted for movement thereon. Passenger seating means are provided which are rotated and translated in a multiplanar manner as the carriage assembly proceeds along the helical portion of the track.

11 Claims, 7 Drawing Figures

34
66
66
ENGAGED
64
44
22

E
F
G
H
I
10
20
21
65

16
17
32
18
21
20
10
10

DISENGAGED
60
5
6
70
22
44
32
42
36
66
65
64
34
54
50
43
48
21
40
33
18
38
46
20
52

ROLLER COASTER ASSEMBLY

The present invention is directed to an improved roller coaster system. In particular, the invention is directed towards a system having a track in the shape of a modified mobius band, wherein passengers are subjected to multiplanar rotation and translation as the roller coaster which they are riding proceeds along the track.

Typical prior art systems are disclosed in the Cerruti U.S. Pat. No. 814,939, and the Pewitt U.S. Pat. No. 2,498,450.

The Cerruti patent shows an amusement railway system wherein a carriage is caused to revolve around the passengers as it proceeds along a track. The passengers seated within the carriage are maintained unruffled and seated in an upright position since they are located in a "basket" which is allowed to rotate freely about the longitudinal axis of the carriage. Thus the purpose of this patent is to create an illusion that the passengers themselves are being rotated whereas they are always upright and it is the carriage which rotates around them.

The Pewitt patent discloses a pleasure railway consisting of a passenger "car" constructed so that it may be rotated end over end as it proceeds along a track.

The present invention differs from the amusement railway concepts disclosed in Pewitt and Cerruti in that persons utilizing the disclosed roller coaster system are subjected to multiplanar rotation as well as to change of positions in relation to other passengers.

In the preferred embodiment, the track is subjected to a series of half twists in the shape of a mobius band and the roller coaster is comprised of a train of individual units each containing two passenger seats, positioned side-by-side in relation to one another. As the carriage moves along the helical or twisting portion of the mobius track, the positions of the passengers in relation to one another are interchanged for each half twist of the track. If this part of the ride is allowed to take place in a darkened enclosure, for example, a darkened tunnel, a certain element of mystery is added to the excitement of the ride, for the rider who was positioned on the left passenger seat is not positioned where the right passenger used to be and vice versa.

This effect is due to the characteristics of a mobious surface. As is illustrated in the Pressman patent, U.S. Pat. No. 3,648,407, a mobious surface is obtained when a cylindrical strip is cut, one end given one or more half twists, (180° turns) and then reunited with the other end. This forms a continuous one-sided surface which is difficult for someone, including passengers riding a roller coaster system, to comprehend.

IN THE DRAWINGS

FIG. 5(*a*) shows a blown up view, partly in cross section, of the clutch assembly in an engaged position.

Figure 1:
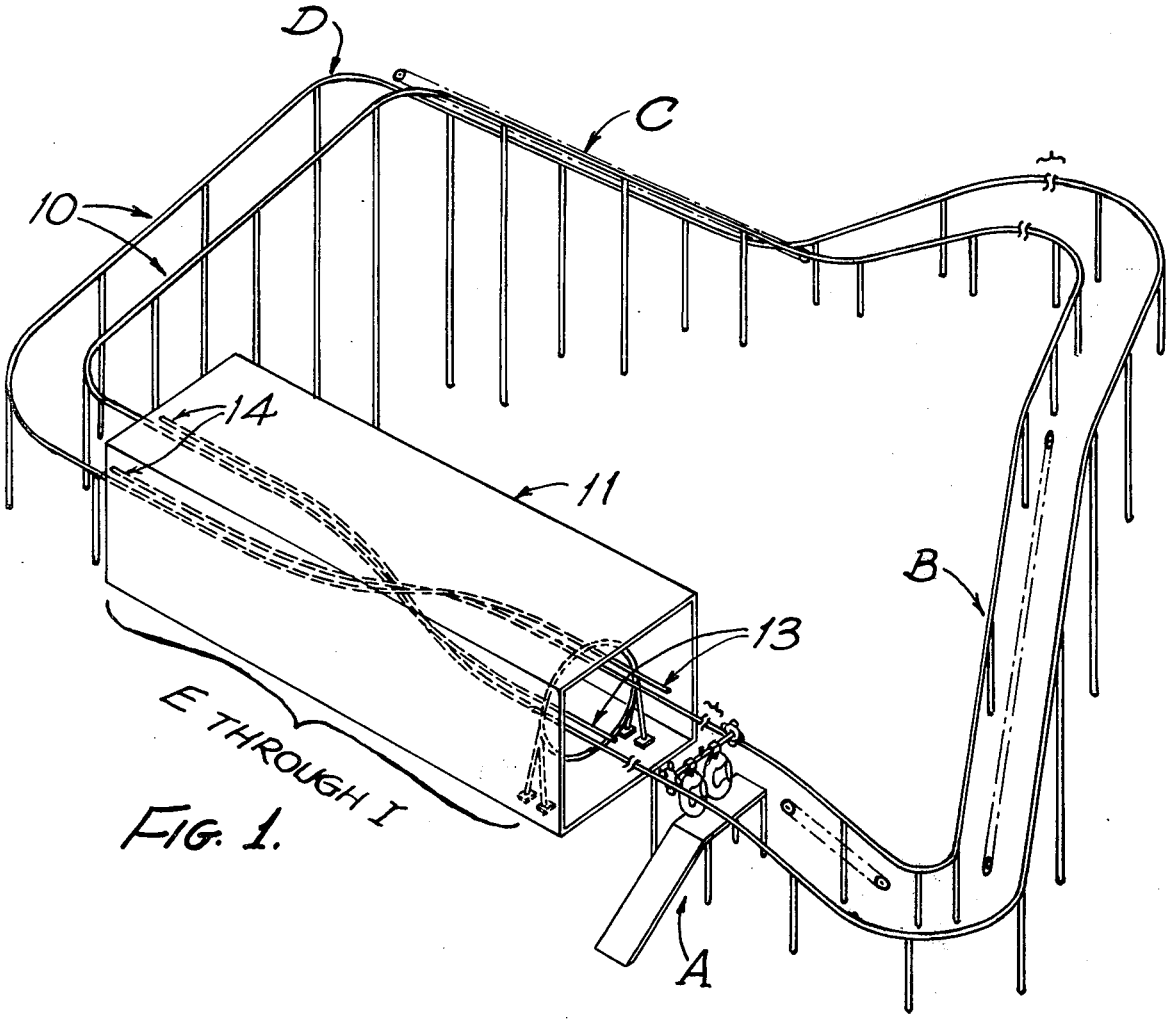
FIG. 1 is a plan view, showing a typical track layout.

Referring to the drawings, FIG. 1 shows a suggested track layout comprising of rails 10 defining a modified mobius band. The track lays flat or horizontal in relation to the ground except for that portion of the track designated letter "E" through "I" in FIG. 1. This portion of the track may be enclosed in a darkened tunnel 11, and contains that portion of the track which is helical in nature.

Figures 2, 3, 5A:
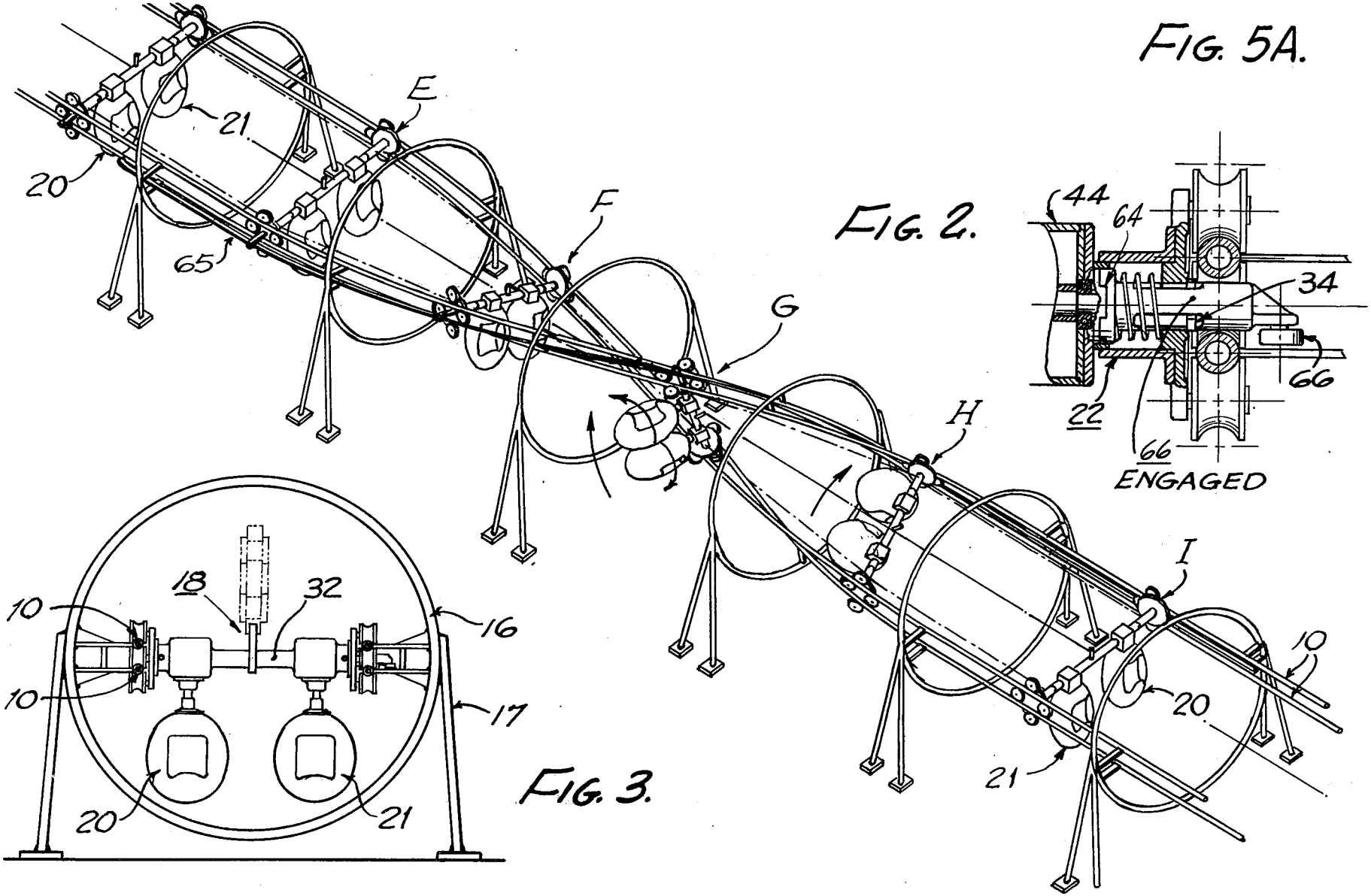
FIG. 2 shows a prespective view of the roller coaster system layout corresponding to sections "E" through "I" of FIG. 1 showing the positions of an individual roller coaster unit at various points on the track as the unit moves through the helical portion of the track.
FIG. 3 shows a plan view of the preferred embodiment of the system showing an individual roller coaster unit on the track, and the support structure thereof.

Portion "E" through "I" of the track is reproduced in more detail FIG. 2. While FIGS. 1 and 2 show a track configuration having a one half twist, this disclosure is by way of example only, and it is within the spirit of this invention to include a track configuration wherein more than a one half twist of the track is utilized.

It is noted that a double rail is utilized in the helical or mobius portion of the track "E" through "I" for purposes of stabilization. This is accomplished merely by overlapping the rails as shown in FIG. 1. Although it may not be needed, the overlapping may extend throughout the entire portion of the track to form a double rail mobius strip. Thus rail ends 14, in FIG. 1 may be extended throughout the entire length of the track and joined with rail ends 13. This format shows the interesting characteristics of the mobius band concept, for the lower set of rails at point E become the upper set of rails at that same point if the path of the rails is followed clockwise around the track and overlapped.

In operation, the roller coaster is typically loaded and unloaded at a station generally designated by the letter "A". After the passengers are loaded, the roller coaster is propelled along the track on that portion generally designated by the letter "B" by a system of endless chain drives to an incline generally referred to by letter "C". At this point the chain drive system propells the roller coaster up the incline to apex "D". The roller coaster is then released and allowed to roll down the declining slope. The roller coaster then gathers momentum and enters the helical portion of the track referred to by letters "E" through "I" in FIG. 1. This is the portion of the track wherein the roller coaster and the passengers are subjected to various multiplanar rotations. After the roller coaster leaves this helical portion of the track it is then returned to the loading station at position "A" where it is stopped for the unloading and reloading of passengers.

FIG. 2 shows a detailed blown-up perspective view of Section "E" through "I" of the track. Since this is the portion of the system wherein the track is in a helical configuration, the roller coaster rolls on a double set of rails. In the preferred embodiment of FIG. 2 the rails are circular in cross-section. These rails are fastened to the inside of circular supports 16 which are in turn supported by a series of A-frame supports 17. Of course other supports and other rail cross-sections may be used to accomplish the same result.

Figure 6:
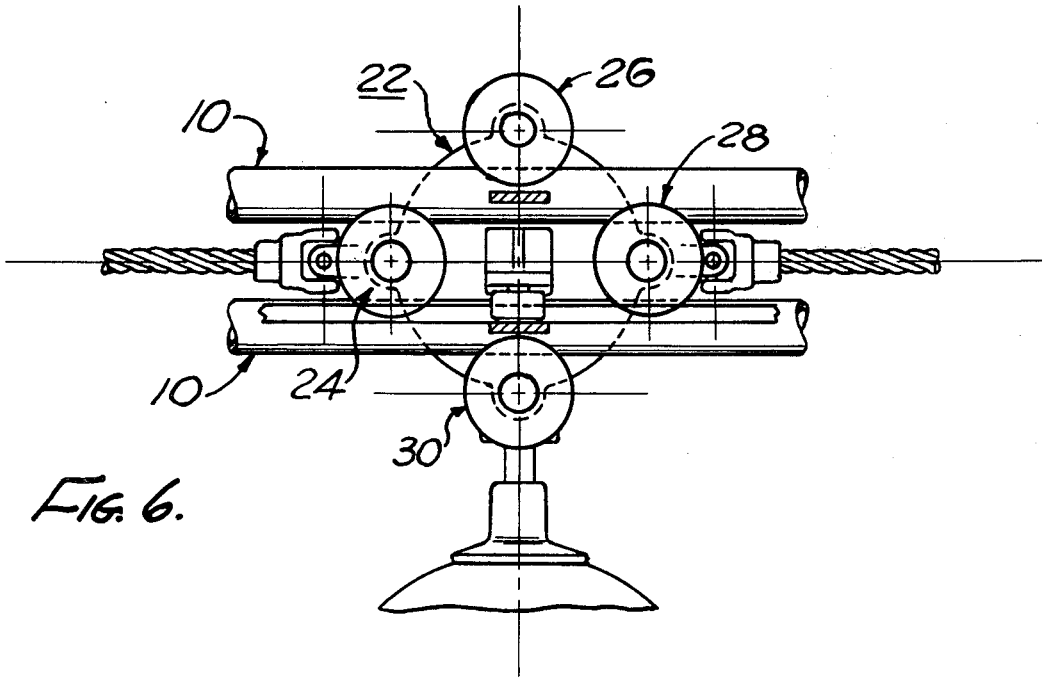
FIG. 6 shows an end view of the embodiment corresponding to FIGS. 4 and 5 above.
Figures 4, 5:
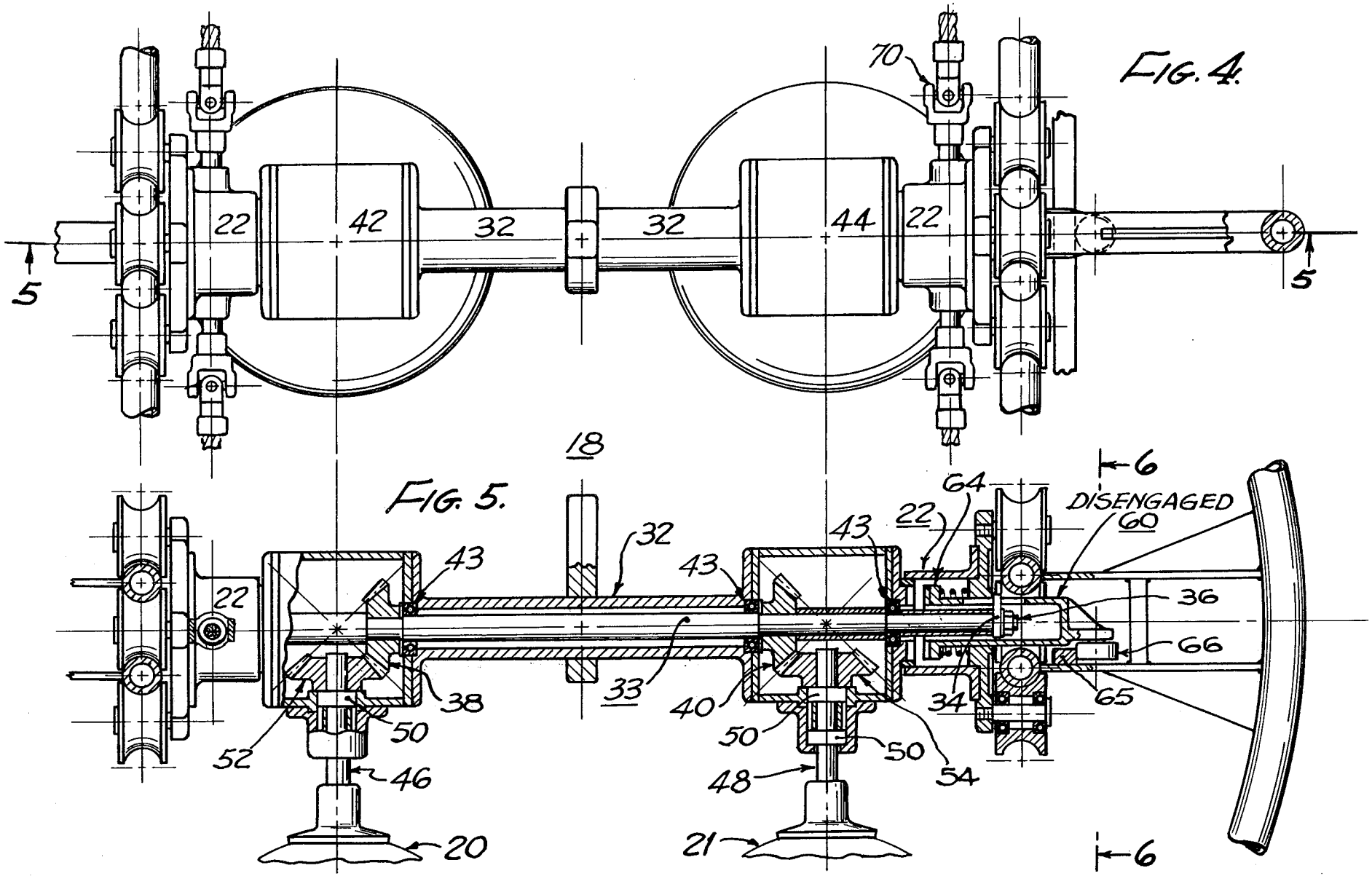
FIG. 4 shows a top view of the carriage assembly.
FIG. 5 shows a frontal plan view, partly in cross-section, of the embodiment corresponding to FIG. 4 above.

As is shown by FIGS. 2 and 3, the roller coaster assembly may be comprised of a train of units each having carriage assembly 18 having support means such as axle housing or support member 32 which is connected to passenger seating means 20 and 21. FIGS. 4, 5 and 6, depict top, front and end views of the preferred embodiment of the roller coaster carriage assembly 18, which is mounted on the track for movement thereon by means of end housing or wheel support assemblies 22 each of which supports wheels 24, 26, 28 and 30 which engage the track rails 10. At least three of these wheels continuously engage the track rails depending on the position of the carriage assembly on the tracks.

The carriage assembly 18 is comprised of an axle housing or support member 32 which is revolvable around a central cross member 33 which is in turn connected and locked to wheel support assemblies or to end housings 22, by means of star washer 34 and locking unit 36. Bevel gears 38 and 40 are keyed to this central cross member 33. Axle housing assembly 32 includes and is connected to gear boxes 42 and 44 rotatably mounted on bearings 43 so as to be concentrically revolvable around central cross-member 33. Rotatable shafts 46 and 48 are connected to and supported by gear boxes 42 and 44 respectively by bearings 50. Bevel gears 52 and 54 are keyed to rotatable shafts 46 and 48 and mesh with gears 38 and 40. The passenger seating means are in the form of encapsulated seats 20 and 21 which are connected to rotatable shafts 46 and 48.

As shown in FIG. 5A, in the preferred embodiment the carriage assembly 18 is equipped with spring-loaded clutch 60 which engages either or both end housing 22 with the axle housing assembly 32. Clutch member 64 is splined and passes within end housing 22. When the carriage assembly enters the helical portion of the track clutch member 64 is displaced outwardly by virtue of either a raised portion of one of the tracks or a separate track 65 acting on cam wheel 66. Thus, when the carriage assembly enters the helical portion of the mobius track, the clutch is disengaged allowing the axle housing assembly to rotate freely around central cross member 33 as dictated by the gravitational forces exerted by the seating means 20 and 21 seeking to reach equilibrium. Seating means 20 and 21 act as pendulums as they are supported by and swing from axle housing 32 which is free to rotate about central cross member 33. Universal joints 70 are connected to end housings 22 for purposes of linking a series of roller coaster units together in a train.

In operation, when the roller coaster train assembly is loaded at position "A" of the track (FIG. 1) and moved up incline "C" to apex "D" and released, the train picks up speed and enters the helical portion of the track Sections "E" through "I" with appreciable built up momentum, thus causing the carriage assembly and roller coaster train to be rotated axially from a horizontal position in accordance to the helical geometry of the rails.

Turning to FIG. 2, it is noted that the carriage assembly begins its rotation at point F in a clockwise direction. After point G as the rotation exceeds about 90° the displacement of the passenger seating means causes the center of gravity of the passenger seating means to locate above the center of gravity of the carriage assembly causing the housing to rotate. Therefore, seats 20 and 21 are urged to rotate about their axis as gravity causes the axle housing assembly to rotate about the central cross member 33 as the system seeks gravitational equilibrium. At point "H" the carriage assembly rotation approaches 120° and since the axle housing assembly rotates freely around central cross member 33 (by virtue of the fact that the clutch has been deactivated by rail 66) the seats continue to rotate about their axis as well as to undergo multiplanar rotation by virtue of the helical gyrations of the track.

In other words, as the roller coaster passes through the mobius section (A mobius being a surface with only one side, formed by giving one or more half twists to a narrow, rectangular strip (a ribbon) and joining the two ends to form a loop), gravity dictates that the passenger seating means seek the lowest position relative to the carriage assembly. The seating means will either fall forward or backward. As the seats fall, the falling causes gears (52 & 54) affixed to shafts 46 and 48 to rotate around gears (38 & 40) which are fixed in relation to the end housings. In the preferred embodiment the gear ratio is such that the seats rotate 180°, thus the passengers again face forward. One seat rotates clockwise, the other counterclockwise.

Thus, when point "I" is reached, the passengers have in effect switched places as well as having undergone rotation. Thus, when a passenger passes through this portion of the mobious track, his position is switched with regard to the position of the other passenger in the same unit.

Having fully described our invention, it is understood that I am not to be limited to the details herein set forth, but that my invention is of the full scope of the appended claims.

I claim:

1. A roller coaster system comprising: a carriage assembly including a central cross member;

at least one rotatable shaft depending from said central cross member and in mechanical communication therewith;

a track of mobius configuration;

housing and gear means for mechanically coupling the central cross member to said rotatable shaft;

means for translating said carriage assembly including said central cross member along said track, the axis of said central cross member being substantially perpendicular to the axis of the track;

passenger seating means connected to said rotatable shaft;

whereby as the carriage assembly advances along the mobius track, and the central cross member is caused to rotate about the axis of the track from its initial position, the passenger seating means coupled to said rotatable shaft are also caused to translate about said track axis until their centers of gravity are located above the center of gravity of the central cross member thereby causing the passenger seating means to swing from the axis of the central cross member as well as to rotate axially.

2. The combination set forth in claim 1 including means for holding said seating means in a fixed relationship with said central cross member and means for disengaging said seating means from said central cross member when the carriage assembly is in the helical portion of the track.

3. The combination set forth in claim 1 wherein the means for translating said carriage assembly along said track includes at least one end housing assembly connected to said central cross member, said end housing having wheel means which roll upon said track.

4. The combination set forth in claim 3 wherein the said seating means are held in a fixed relationship with said central cross member by means of a clutch comprised of a spring loaded armature within said end housing, said clutch being disengaged by a track activating means as it enters the helical portion of the track.

5. The combination set forth in claim 1 wherein the track is supported by circular support means which are in turn held in place by A-frame supports on either side thereof.

6. A roller coaster system comprising a track of mobius configuration;

a carriage assembly movably coupled to the track;

passenger seating means connected to said carriage assembly;

said carriage assembly comprised of a central cross member;

an axle housing rotatably surrounding said central cross member and having at least one gear box;

each gear box supporting a passenger seating means by means of a rotatable shaft coupled thereto and depending from said central cross member;

means for mechanically coupling said central cross member to said rotatable shaft;

whereby as the carriage assembly proceeds along the helical portion of the track, and said cross member is thereby rotated about the axis of the track from an initially substantially horizontal position to a substantially vertical position, the rotatable shafts coupled thereto are in turn caused to translate from substantially initially vertical positions to substantially horizontal positions until a gravitational imbalance is reached which causes said axle housing to rotate about said central cross member in turn causing the rotatable shafts and the passenger seating means connected thereto to rotate around their respective axis.

7. The combination set forth in claim 6 wherein the central cross member is connected to end housing assemblies having at least one wheel mounted thereon engaging the track.

8. The combination set forth in claim 7 wherein at least one of said housing assemblies is held in a fixed relationship with said central cross member by means of a clutch comprised of a spring-loaded armature within said end housing assemblies which is released when said armature becomes disengaged as the roller coaster assembly is within the helical portion of the mobius track.

9. The combination set forth in claim 8 wherein the clutch is comprised of a spring loaded armature within at least one of said end housings, said clutch being disengaged by a track activating means when it is within the mobius or helical portion of the track.

10. A roller coaster system comprising a track in the form of a mobius band having at least a one-half twist, a carriage assembly mounted on said track for movement thereon, guide means for cooperatively connecting said carriage and said track and for maintaining said carriage assembly on said track, passenger seating means connected to said carriage, wherein said carriage assembly is comprised of a central cross member, support means rotatably coupled to said central cross member, said support means coupled to the passenger seating means by means of a rotatable shaft dependent from said central cross member and mechanically coupled thereto; said central cross member being in mechanical communication with the rotatable shaft so that as the carriage assembly proceeds on the helical portion of the track, and is thus caused to rotate from its initially horizontal position, the gravitational imbalance caused by the position of the passenger seating means causes said support means to rotate around said central cross member and by virtue of this rotation the rotatable shaft and the passenger seating means connected thereto are caused to rotate about their axis.

11. The combination set forth in claim 10 including means for holding the seating means in a fixed orientation when the carriage assembly is travelling in that portion of the track which is not helical in configuration and means for releasing said seating means when the carriage assembly is in the helical portion of the track.

* * * * *